US006117626A

United States Patent [19]

Yamane et al.

[11] Patent Number: 6,117,626

[45] **Date of Patent: *Sep. 12, 2000**

[54] PHOTOGRAPHIC SILVER HALIDE PHOTOSENSITIVE MATERIAL AND PHOTOGRAPHIC COMBINATION USING THE SAME

[75] Inventors: Katsutoshi Yamane; Takayoshi Oyamada, both of Kanagawa, Japan

[73] Assignee: Fuji Photo Film Co., Ltd., Kanagawa, Japan

[ * ] Notice: This patent is subject to a terminal disclaimer.

[21] Appl. No.: 08/979,437

[22] Filed: Nov. 26, 1997

[30] Foreign Application Priority Data

Dec. 6, 1996 [JP] Japan ..... 8-342636

[51] Int. Cl.[7] ..... G03C 1/035; G03C 5/17

[52] U.S. Cl. ..... 430/509; 430/567; 430/966; 430/967; 250/484.2; 252/301.4 S

[58] Field of Search ..... 430/966, 605, 430/509, 967, 567; 250/484.2; 252/301.4 S

[56] References Cited

U.S. PATENT DOCUMENTS

| | | | |
|---|---|---|---|
| 4,346,167 | 8/1982 | Imatomi et al. | 430/569 |
| 4,585,729 | 4/1986 | Sugimoto et al. | 430/502 |
| 5,449,599 | 9/1995 | Heremans | 430/567 |
| 5,824,460 | 10/1998 | Dickerson | 430/502 |
| 5,853,945 | 12/1998 | Yamane et al. | 430/139 |

FOREIGN PATENT DOCUMENTS

| | | | |
|---|---|---|---|
| 874275 | 10/1998 | European Pat. Off. | G03C 5/16 |

*Primary Examiner*—Mark F. Huff

*Attorney, Agent, or Firm*—Sughrue, Mion, Zinn, Macpeak & Seas, PLLC

[57] ABSTRACT

A mammographic silver halide photosensitive material has at least one photosensitive emulsion layer on either one surface of a support. The emulsion layer is formed of a silver halide emulsion having an iodide content of less than 0.9 mol % based on silver. The photosensitive material exhibits a contrast of 3.7–4.8 as determined by processing the material by specific Developing Process (1). The photosensitive material is combined with a radiographic intensifying screen of $Gd_2O_2S$:Tb phosphor having a CTF of 0.40–1.00 at a spatial frequency of 5 lp/mm to construct a photographic combination.

7 Claims, No Drawings

PHOTOGRAPHIC SILVER HALIDE PHOTOSENSITIVE MATERIAL AND PHOTOGRAPHIC COMBINATION USING THE SAME

BACKGROUND OF THE INVENTION

This invention relates to a photographic silver halide photosensitive material and a photographic combination of a photographic silver halide photosensitive material with a radiographic intensifying screen. More particularly, it relates to a photographic silver halide photosensitive material and a photographic combination capable of forming improved images in the area of mammography of photographing soft tissue using low-energy X-rays radiated at a tube voltage of less than 40 kVp, especially forming images of consistent high quality under different service conditions.

The number of breast cancer patients is increasing in these years. Common means for the examination and diagnosis of breast cancer include touch, ultrasonography, and mammography or breast radiography. Among others, the mammography using fluorescent screens is believed more effective. With respect to the advance of breast diagnostic systems, reference should be made to the literature, for example, Phys. Med. Biol., 41 (1996), 315.

Radiography using fluorescent screens has been frequently used in the medical field for photographing chest, abdomen and stomach. Among these, the breast photographing radiography is regarded as a special one from the standpoint of developing a screen/photographic silver halide photosensitive material system therefor. More particularly, the mammography carries out photographing using low-energy X-rays radiated at a tube voltage of less than 40 kVp, which are seldom used in ordinary radiography, for the purpose of compensating for the very low contrast of a breast or subject. Also very high sharpness is required since very fine calcified images of the order of several hundred micrometers in size must be observed. Since the mammography uses a different radiation source and requires different performance than the ordinary radiographic system, different performance and design are required for its screen/photographic silver halide photosensitive material system. Engineers can little rely on the technology developed for the conventional radiography. Each manufacturer has developed and marketed a system specialized for mammography. A number of modifications have been reported.

U.S. Pat. No. 4,914,303 discloses a screen for mammography wherein stationary noise is minimized by optimizing a luminophore size distribution. Also, JP-B 18955/1995 discloses a method for producing a screen of high image quality by optimizing a dye distribution of a fluorescent layer. These proposals relate to the screen alone and their level of improvement is approximate to currently commercially available screens and still insufficient.

JP-A 179145/1989 and 45807/1993 disclose photographic silver halide photosensitive materials for mammography. These materials are still unsatisfactory. There is a demand for further improvement. As seen from Examples of these patent specifications, the photosensitive materials have a contrast of less than 3.6, suggesting that an effective photosensitive material having a high contrast sufficient for mammography has not been developed. In 1996, Eastman Kodak Company marketed a new photosensitive material MinR2000, which merely has a contrast of 3.5 falling in the range of the existing system. Also EP 0712036 discloses a novel mammographic system wherein the contrast is only 3.6 which does not surpass the prior art range.

Although engineers have sought for high contrast photosensitive material, it is technically difficult to produce a photosensitive material having a high contrast in the desired sensitivity range. According to our research, if the contrast is increased above 3.6, such a photosensitive material is inconvenient to use because the photographic density largely varies with a differential variation of a developer in a day. When one tries to increase the contrast of photosensitive material as an extension of the prior art, the graininess is exacerbated beyond the permissible range, that is, favorable results are not always obtained.

Despite the increased demand for the diagnostic efficacy of mammography, no engineers could find a new key toward further development.

Although the mammography generally uses one sheet of intensifying screen and a one-side photosensitive material, JP-B 18956/1995 discloses a double side system using two front and back intensifying screens for achieving high image quality. In this system, however, no substantial advances are found because of an unsharpening effect resulting from the crossover light between the double side screens, mixing of scattered radiation, and the too thin front intensifying screen. Several specific screens are described in Examples, all of which are intensely colored and contain a phosphor with a large particle size. Even if such a screen is used only on one side, the screen itself is not advanced in performance.

JP-A 96740/1990 discloses a system wherein a fluorescent layer and a photosensitive layer are simultaneously coated on a support. Since this system does not reuse the phosphor, it lacks reality for the screening application in that a single radiographic shot becomes expensive.

Though not designed for mammography, high sharpness one-side photosensitive material systems are disclosed in JP-A 43861/1995 and WO 93-01522. However, the system of JP-A 43861/1995 exhibits a sharpness which is insufficient for mammographic use and lacks the concept of designing a high contrast photosensitive material. The system of WO 93-01522 uses a ultraviolet emitting phosphor. Although its screen can be designed so as to exhibit a high sharpness, an extension of this system never reaches a satisfactory mammographic system.

Despite these numerous attempts, no satisfactory results have been achieved and no commercial items have been widespread.

In the area of mammography possessing the unique feature distinguishable from the ordinary radiography in that photographing is done with low-energy X-rays, the development of a high image quality system has been desired for improving the diagnostic efficacy.

SUMMARY OF THE INVENTION

An object of the invention is to provide a novel and improved photographic silver halide photosensitive material having a high contrast sufficient for mammography, featuring stable processing, and forming a radiographic system.

Another object of the invention is to provide a novel and improved photographic combination of a photographic silver halide photosensitive material with an intensifying screen to construct a radiographic system featuring a good balance of image quality and sensitivity.

In a first aspect, the invention provides a photographic silver halide photosensitive material comprising at least one photosensitive emulsion layer only on one side of a support and adapted for use in photographing soft tissue using low-energy X-rays radiated at a tube voltage of less than 40 kVp. The at least one photosensitive emulsion layer is formed of a silver halide emulsion having an iodide content of less than 0.9 mol % based on the moles of silver. The silver halide photosensitive material exhibits a contrast of 3.7 to 4.8 as determined by processing the material by Developing Process (1). Developing Process (1) is to develop the photosensitive material at a temperature of 35° C. for a time of 25 seconds with a developer (G) of the following composition:

| | |
|---|---|
| potassium hydroxide | 21 g |
| potassium sulfite | 63 g |
| boric acid | 10 g |
| hydroquinone | 25 g |
| triethylene glycol | 20 g |
| 5-nitroindazole | 0.2 g |
| glacial acetic acid | 10 g |
| 1-phenyl-3-pyrazolidone | 1.2 g |
| 5-methylbenzotriazole | 0.05 g |
| glutaraldehyde | 5 g |
| potassium bromide | 4 g |

The developer (G) has been diluted with water to a total volume of 1 liter and adjusted to pH 10.2.

Preferably, the photosensitive material includes at least two photosensitive emulsion layers only on one side of a support. The at least two photosensitive emulsion layers are formed of silver halide emulsions having different sensitivities. The sensitivity of the photosensitive emulsion of the uppermost layer is lower than that of a lower layer.

The photosensitive emulsion layer is preferably formed of a silver halide emulsion having an iodide content of less than 0.3 mol % based on the moles of silver and a coefficient of variation of silver halide grain size of less than 15%. The photosensitive emulsion layer is preferably formed of a silver halide emulsion doped with $1\times10^{-8}$ to $5\times10^{-8}$ mol of a rhodium compound per mol of silver.

In a second aspect, the invention provides a photographic combination of the photographic silver halide photosensitive material defined above and a radiographic intensifying screen comprising a phosphor consisting essentially of terbium-activated gadolinium oxysulfide ($Gd_2O_2S$:Tb). The intensifying screen has a contrast transfer function (CTF) of 0.40 to 1.00 at a spatial frequency of 5 lp/mm. Preferably, the intensifying screen has a fluorescent layer which is substantially undyed and contains the phosphor at a packing factor of 65 to 80% by volume.

DETAILED DESCRIPTION OF THE INVENTION

Photosensitive material

In the photographic silver halide photosensitive material of the present invention, at least one photosensitive emulsion layer is formed of a silver halide emulsion having an iodide content of up to 0.9 mol % based on the moles of silver. The silver halide photosensitive material exhibits a contrast of 3.7 to 4.8 as determined by Developing Process (1) under predetermined conditions. The photosensitive material featuring such a high contrast can produce an image of quality in the area of mammography where soft tissue is photographed using low-energy X-rays radiated at a tube voltage of less than 40 kVp. The limited iodine content of the silver halide emulsion is effective for restraining a variation of processing performance which can otherwise occur in high contrast photosensitive materials and ensures stable photographic performance even when the material is processed with a developer which has been oxidized and deteriorated with the lapse of time.

In contrast, if the iodide content of the silver halide emulsion is more than 0.9 mol %, the stability of photographic performance is lost. Additionally, roller marks and residual color become unsatisfactory. If the contrast is less than 3.7, an image suitable for mammography is not obtainable. A contrast above 4.8 undesirably leads to a narrow exposure latitude.

More effective means for imparting a high contrast to the photosensitive material include (A) constructing the silver halide emulsion layer as a multi-layer construction such that the sensitivity of the photosensitive emulsion of the uppermost layer is lower than that of a lower layer, (B) forming at least one photosensitive emulsion layer from a silver halide emulsion having a coefficient of variation of silver halide grain size of less than 15%, and (C) forming at least one photosensitive emulsion layer from a silver halide emulsion doped with $1\times10^{-8}$ to $5\times10^{-8}$ mol of a rhodium compound per mol of silver.

The stability of photographic performance is further improved by forming at least one photosensitive emulsion layer from a silver halide emulsion having an iodide content of less than 0.3 mol % based on the moles of silver.

The photographic silver halide photosensitive material of the invention exerts its characteristics to a full extent when incorporated in a photographic combination with a radiographic intensifying screen comprising a phosphor consisting essentially of terbium-activated gadolinium oxysulfide ($Gd_2O_2S$:Tb) and having a sharpness corresponding to a contrast transfer function (CTF) of 0.40 to 1.00 at a spatial frequency of 5 lp/mm. The photographic combination of such construction according to the invention features a high contrast, high sensitivity and high detectivity.

The intensifying screen favors from the standpoint of its luminescence intensity that a fluorescent layer is not substantially dyed. A screen of higher sharpness is obtained when the fluorescent layer contains the phosphor at a packing factor of 65 to 80% by volume. The thickness of the fluorescent layer is preferably 50 to 120 $\mu$m because the screen can be increased in luminescence intensity and given a contrast transfer function (CTF) of at least 0.40 at a spatial frequency of 5 lp/mm.

The "contrast" determined by subjecting the photosensitive material to Developing Process (1) is the gradient of a straight line connecting a point of fog+0.25 and a point of fog+2.0 on a characteristic curve drawn on orthogonal coordinates of an equal unit length with a logarithm of an X-ray exposure plotted on the abscissa and an optical density plotted on the ordinate. The gradient is $\tan\theta$ wherein $\theta$ is an angle between the straight line and the abscissa.

It is described how to draw a characteristic curve of the photosensitive material.

In mammography, exposure is made using a molybdenum target tube adapted to radiate X-rays at a low voltage. Insofar as an intensifying screen comprising a phosphor consisting essentially of terbium-activated gadolinium oxysulfide ($Gd_2O_2S$:Tb) is used, no substantial change is found when a characteristic curve is determined by using X-rays radiated from a tungsten target tube as a radiation source and changing the X-ray exposure by the distance method.

More specifically, the measurement was carried out as follows. A tungsten target tube was operated by a three-phase power supply at 50 kVp to generate X-rays which were transmitted by an aluminum plate of 3 mm thick. A photosensitive material or film to be measured was placed in close contact with a screen commercially available under the trade name of UM-Mammo Fine. An ECMA cassette by Fuji Photo-Film Co., Ltd. was loaded with this combination.

After the cassette was set relative to the X-ray tube so as to arrange the X-ray tube, the cassette top plate, the film, and the screen in the described order, the film was exposed to X-rays. While an X-ray exposure E was changed by the distance method, step exposure was done at a width of logE=0.15. The exposure time was 1 second.

Using an automatic processor commercially available under the trade name of FPM-5000 from Fuji Photo-Film Co., Ltd., the exposed film was processed with the developer (G) at 35° C. for 25 seconds (RP processing). The developed film was measured for optical density. A characteristic curve was drawn by plotting a logarithm of an exposure of irradiated radiation on the abscissa and an optical density on the ordinate. The contrast is the gradient of a straight line connecting density points of fog+0.25 and fog+2.0 on the characteristic curve. That is, the contrast was determined as tanθ wherein the straight line forms an angle θ with the abscissa.

By the same sensitometry, the photosensitive material can also be determined for sensitivity. The sensitivity is a reciprocal of an exposure necessary to provide an optical density of 1.0.

The photosensitive material of the invention exhibits a contrast of 3.7 to 4.8, more preferably 3.8 to 4.5.

Any desired method may be used in preparing a photosensitive material having a characteristic curve satisfying the requirement of the invention. In one preferred embodiment, such a photosensitive material is prepared by coating at least two photosensitive emulsions having different sensitivities to form separate layers such that a low sensitivity emulsion may form an upper layer and a high sensitivity emulsion may form a lower layer. The sensitivity difference between the low and high sensitivity emulsions is preferably in the range of 0.05 to 0.50, more preferably 0.15 to 0.4, as expressed by logE (logarithm). A better contrast is obtained by coating at least three photosensitive emulsions having different sensitivities to form separate layers such that upper to lower layers are formed of low to high sensitivity emulsions in order. With the relationship of the improvement achieved and the economy taken into account, it is less meaningful to form four or more emulsion layers. It is preferred that the amount of green light absorbed by the upper emulsion layer is smaller than that by the lower emulsion layer. In this sense, better results are obtained when the uppermost emulsion layer contains a mixture of a green sensitizing dye and a blue sensitizing dye. The amounts of the emulsion in plural layers are preferably equal among the layers provided that the emulsion amount is expressed by the weight of silver.

It is generally believed for mammographic photosensitive material that the management of a finished photographic density is important. That is, the exposure device and the developer must be managed such that an equal density is always obtained when films are photographed under the same conditions. Especially in the case of high contrast photosensitive material as used herein, a sensitivity variation associated with a daily change of the developer is reflected by a significant density variation. It is very important that the photosensitive material of the invention have the ability that its sensitivity and gradation remain unchanged for a more or less variation of the developer. According to our research work, such ability is more readily achieved when the silver halide coated on the photosensitive material has a lower iodide content. In order to attain the objects of the invention, at least one layer of the above-mentioned two or more emulsion layers should have an iodide content of 0 to 0.9 mol % based on the moles of silver. More preferably the iodide content is in the range of 0 to 0.3 mol %. Then a stable photosensitive material is obtained which experiences a minimal change of sensitivity and gradation for a differential variation of the developer in a day or days.

To impart processing stability, the hardened state of photosensitive material falls in a preferred range. When the emulsion surface of photosensitive material or film is swollen with water at 25° C., a swelling factor is defined as the thickness of the swollen film divided by the thickness of the dry film. It is preferred that the swelling factor is in the range of 180% to less than 400%, especially 200% to 350%. If the swelling factor is set below the range, the photosensitive material would undesirably experience a substantial change of sensitivity and gradation for a variation of processing conditions. If the swelling factor is set above the range, there would be undesirably produced more black spots, known as roller marks, on the film by feed rollers in the automatic processor.

It is understood that such roller marks are also reduced by setting the iodide content of the photosensitive material in the above-defined low range. The above consideration suggests that the photosensitive material of the invention is prepared as a softer film or to a greater swelling factor whereby processing stability is further improved. When the photosensitive material bears a layer having a low iodide content and has a relatively greater swelling factor, the photosensitive material after processing is also significantly improved in residual color (the amount of dye left in the photosensitive material), residual silver, and residual hypo.

In order that the photosensitive material experience a minimal change of density for a variation of the developer, the emulsion should preferably be sensitized with selenium, more preferably with selenium, sulfur and gold. The preferred amount of a selenium sensitizer added is $5\times10^{-7}$ to $2\times10^{-5}$ mol, more preferably $1\times10^{-6}$ to $1\times10^{-5}$ mol per mol of silver.

In order to produce a photosensitive material exhibiting a high contrast despite a low iodide content as mentioned above, the silver halide emulsion having a low iodide content should preferably have a monodisperse particle size distribution. Provided that a coefficient of variation of particle size (%) is defined as the deviation of particle size divided by a mean particle size×100, an emulsion having a particle size distribution with a coefficient of variation of less than 15%, especially less than 13% is preferred. The lower limit of the coefficient of variation is usually about 3%.

In order to produce a photosensitive material exhibiting a high contrast despite a low iodide content as mentioned above, the silver halide emulsion having a low iodide content should preferably contain $1\times10^{-8}$ to $5\times10^{-8}$ mol of rhodium per mol of silver. Less than $1\times10^{-8}$ mol of Rh is little effective for enhancing the contrast whereas more than $5\times10^{-8}$ mol of Rh would cause practically unacceptable desensitization. Rhodium compounds may be added by any of well-known methods. Preferably a rhodium compound is added by introducing the rhodium compound in a halide solution when grains are formed. Various rhodium compounds are useful although $(NH_4)_3RhCl_6$ and $K_3RhBr_6$ are preferred.

No limit is imposed on the shape of silver halide grains although tabular grains and cubic grains produced by the ammonia process are especially useful.

Of at least two emulsions, the emulsion for an upper layer should preferably contain a mixture of a green absorbing dye and a blue absorbing dye for reducing the green absorption amount. In particular, by adding a green absorbing dye and a blue absorbing dye prior to chemical sensitization, the chemical sensitization can be optimized to thereby prepare a high sensitivity, high contrast emulsion. With respect to the combined use of such dyes, reference should be made to Japanese Patent Application No. 221396/1996.

It is also preferred in the practice of the invention to add a monomethine compound to the emulsion because such a compound is effective for cutting the toe of a characteristic curve for thereby enhancing the contrast. Examples of the monomethine compound used herein are shown below.

1-1

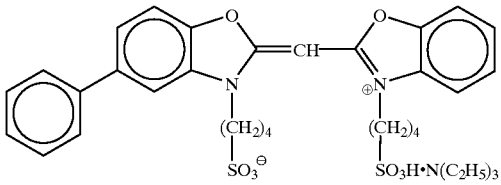

1-2

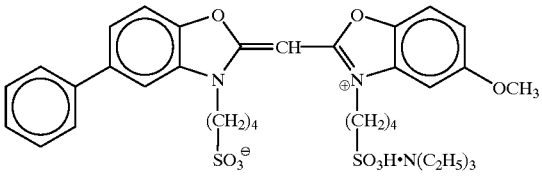

1-3

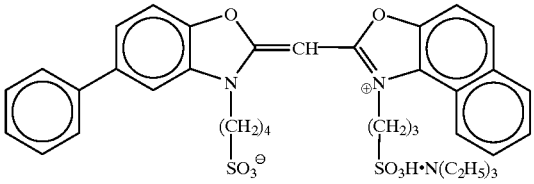

1-4

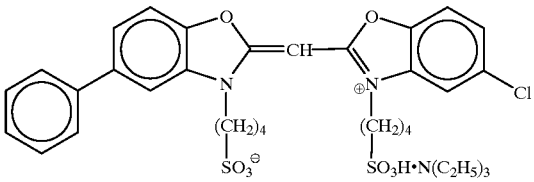

1-5

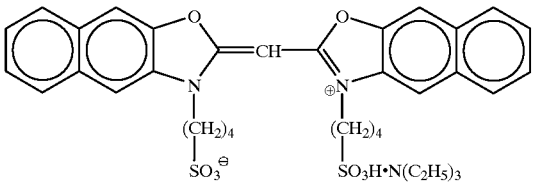

1-6

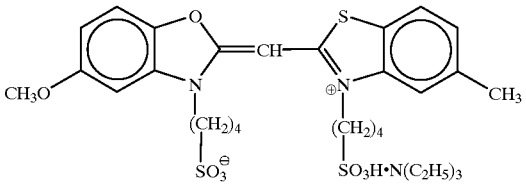

The amount of the monomethine compound used is preferably 50 to 1,000 mg per mol of silver, more preferably 100 to 800 mg per mol of silver.

In a typical construction, the photographic silver halide photosensitive material according to the invention has an emulsion layer on one surface of a transparent support and a non-photosensitive gelatin layer containing a dye on the opposite surface.

The support used herein is formed of a transparent material such as polyethylene terephthalate and preferably colored with a blue dye. The blue dye used herein may be selected from various dyes, typically anthraquinone dyes known to be useful for the coloring of radiographic films. The support may have an appropriate gage in the range of 160 to 200 $\mu$m. A subbing layer of a water-soluble polymer such as gelatin is formed on the support as in conventional radiographic films.

A dye layer may be provided on the subbing layer for anti-halation purpose. The dye layer is generally formed as a colloid layer containing a dye. Preferred is a dye layer which will be bleached by the development defined herein. Desirably, the dye is fixed to a lower stratum of the dye layer so that the dye may not diffuse into the overlying layer, photosensitive silver halide emulsion layer or protective layer.

A photosensitive silver halide emulsion layer is formed on the dye layer. It is understood that the photographic silver halide photosensitive material must have sensitivity to light from an intensifying screen combined therewith. Since conventional silver halide emulsions are sensitive to light in the blue to ultraviolet range and an intensifying screen comprising a terbium-activated gadolinium oxysulfide ($Gd2O_2S$:Tb) phosphor emits light having a main wavelength of 545 nm, the silver halide of the photosensitive material should be spectrally sensitized to green light.

The amount of a binder used in the photosensitive layer is preferably 2 to 5 g per square meter of the photosensitive material (g/m$^2$, hereinafter), more preferably 2 to 4 g/m$^2$. The amount of silver contained in the photosensitive layer is preferably 2 to 5.5 g per square meter of the photosensitive material, more preferably 2 to 5 g/m$^2$, most preferably 2.5 to 4.5 g/m$^2$.

The photographic silver halide photosensitive material according to the invention is obtained by forming a protective layer on a laminate from a water-soluble polymer such as gelatin by a conventional technique. The laminate includes the support, the subbing layer, the anti-halation dye layer optionally formed on the subbing layer, and the photosensitive layer thereon.

No particular limits are imposed on the emulsion sensitizing method, various additives, and constituent materials used in the preparation of the photographic silver halide photosensitive material according to the invention and the developing process. For example, the teachings described in JP-A 68539/1990, 103037/1990, and 115837/1990 are applicable.

| Item | Reference |
|---|---|
| 1 Chemical sensitization | JP-A 68539/1990, P10/UR/L13-LL/L16 |
| 2 Antifoggant, stabilizer | JP-A 68539/1990, P10, LL/L17-P11/UL, L7 and P3/LL/L2-P4/LL |
| 3 Spectral sensitizer | JP-A 68539/1990, P4/LR/L4-P8/LR |
| 4 Surfactant, antistatic agent | JP-A 68539/1990, P11/UL/L14-P12/UL/L9 |
| 5 Matte agent, lubricant plasticizer | JP-A 68539/1990, P12/UL/L10-UR/L10 and P14/LL/L10-LR/L1 |
| 6 Hydrophilic colloid | JP-A 68539/1990, P12/UR/L11-LL/L16 |
| 7 Hardener | JP-A 68539/1990, P12/LL/L17-P13/UR/L6 |
| 8 Support | JP-A 68539/1990, P13/UR/L7-20 |
| 9 Dye, mordant | JP-A 68539/1990, P13/LL/L1- |

-continued

| Item | Reference |
|---|---|
| | P14/LL/L9 |
| 10 Development | JP-A 103037/1990, P16/UR/L7-P19/LL/L15 and JP-A 115837/1990, P3/LR/L5-P6/UR/L10 |

(Note: P: page, UL: upper left column, UR: upper right column, LL: lower left column, LR: lower right column, L: line)

Intensifying Screen

Now preferred embodiments of the intensifying screen to be used in combination with the photosensitive material of the invention are described.

The X-ray intensifying screen used in the photographic combination for mammography according to the invention is required to have a higher resolution than those for chest radiography. In general, commercially available X-ray intensifying screens for mammography are increased in resolution by coloring their fluorescent layer. However, the colored fluorescent layer fails to effectively take out the light emission that is created by X-rays absorbed by the phosphor located in the screen remote from the X-ray incident surface. The X-ray intensifying screen according to the invention is preferably designed as a screen having a phosphor coated in a sufficient amount to absorb X-rays so as to provide a high sharpness without substantial coloring of the fluorescent layer.

To attain the desired target of the screen, the phosphor should preferably have a particle size below a certain limit. The size of fluorescent particles can be measured by the Coulter counter method, electron microscopy and so on. Specifically, the phosphor should preferably have a particle size of 1 to 5 $\mu$m, especially 1 to 4 $\mu$m as expressed by a mean diameter of equivalent sphere. The particle size is important for the mammographic intensifying screen having a substantially undyed fluorescent layer.

To increase the sharpness of such a screen, a lower weight ratio of binder to phosphor in the fluorescent layer is preferable. Specifically, the weight ratio of binder to phosphor is preferably from 1/50 to 1/20, especially from 1/50 to 1/25.

The binder used herein may be selected from well-known binders as described in JP-A 75097/1994, page 4, right column, line 45 to page 5, left column, line 10. Preferably thermoplastic elastomers having a softening temperature or melting point of 30° C. to 150° C. are used alone or in admixture with other binder polymers. Especially, since a screen wherein the amount of the binder is reduced in order to increase sharpness according to the invention tends to become less durable, it is important to select a binder capable of preventing such a loss of durability. As a solution, a choice of a fully flexible binder is recommended. It is also preferred to add a plasticizer to the fluorescent layer. Examples of the thermoplastic elastomer include polystyrene, polyolefin, polyurethane, polyester, polyamide, polybutadiene, ethylene-vinyl acetate, natural rubber, fluoro-rubber, polyisoprene, chlorinated polyethylene, styrene-butadiene rubber, and silicone rubber. Preferred among these is polyurethane. A choice of a binder as a primer under the fluorescent layer is also important. Acrylic binders are preferred primers.

The screen has a surface protective layer. It is preferred that the surface protective layer be thinner insofar as mar resistance and stain resistance are ensured. Specifically, the surface protective layer preferably has a thickness of 2 to 7 $\mu$m. The surface protective layer may be formed of polyethylene terephthalate (PET, especially oriented type), polyethylene naphthalate (PEN) or nylon in the form of a film or laminate of films. It is also preferred from the stain proof standpoint to form a surface protective layer by coating a solution of a fluoro-resin in a solvent. Preferred fluoro-resins are described in JP-A 75097/1994, page 6, left column, line 4 to right column, line 43. Other examples of the resin which can form a surface protective layer by coating its solution include polyurethane resins, polyacrylic resins, cellulose derivatives, polymethyl methacrylate, polyester resins, and epoxy resins.

A high packing factor of the phosphor is also important in providing a high sensitivity, high sharpness screen. Specifically, the fluorescent layer preferably contains the phosphor at a packing factor of 60 to 80% by volume, more preferably 65 to 80% by volume. In order that fine particulates of the phosphor be contained at a high volume packing factor, it is preferred to compress the fluorescent layer as disclosed in JP-A 75097/1994, page 4, right column, line 29 to page 6, left column, line 1.

Also preferably the phosphor used herein consists essentially of terbium-activated gadolinium oxysulfide ($Gd_2O_2S$:Tb). The term "consisting essentially of" means that the major component of the phosphor is $Gd_2O_2S$:Tb and it is permissible to incorporate several percents of an additive for improving the function of the phosphor and to add silica for modifying the surface. It is also possible to partially substitute less than several ten percents of Y, La and/or Lu for Gd.

In general, the phosphor is preferred to have a higher density for effectively absorb X-rays. The phosphor exhibiting such preferred X-ray absorptivity relative to a radiation source used in mammography includes $Gd_2O_2S$:Tb, $YTaO_4$, $YTaO_4$ having various activators added as a light emission center, $CaWO_4$, and BaFBr:Eu.

It is important that the phosphor have a high luminous efficacy. As mentioned above, it is important that a mammographic silver halide photosensitive material have a high gradation or contrast. It is technically difficult to prepare a photosensitive material having both a high contrast and a high sensitivity. In order to obtain satisfactory results even when the sensitivity of the photosensitive material is set low, the intensifying screen should preferably have a high radiance. Where a phosphor having a low luminous efficacy is used, it is difficult to prepare such a high contrast photosensitive material. In order to prepare such a high contrast photosensitive material, it is important that the photosensitive material have sufficiently low light absorption. As previously described in detail, if the photosensitive material, especially the uppermost layer thereof has substantial light absorption, the contrast is reduced by its shielding effect. Since the mammographic photosensitive material intended herein has a coating of silver halide emulsion only on one side of a support unlike the ordinary chest radiographic photosensitive material, this shielding influence becomes significant due to a large amount of the emulsion coated. For the designing of a one-side high contrast photosensitive material intended herein, it is very important to control the light absorption of the photosensitive material fully low. In the case of a phosphor capable of light emission in the ultraviolet to blue range, however, since the intrinsic absorption of silver halide resides in this wavelength range, that absorption becomes too high or it becomes difficult to freely control the absorption. Then for the objects of the invention, it is preferred to use a photosensitive material in which the silver halide is color sensitized, to freely control the light absorption of the photosensitive material by the color sensitization, and to use a phosphor having an emission peak at the wavelength of the color sensitized photosensitive material.

As a result of our investigations made from the above-mentioned several standpoints, we have found that the phosphor suited for use in the screen to be combined with the photosensitive material of the invention is $Gd_2O_2S$:Tb.

For the screen for use in combination with the photosensitive material of the invention, it is important to effectively take out the light emission resulting from X-rays absorbed in the phosphor. It is thus preferred that the fluorescent layer is substantially undyed. In general, to reduce the amount of phosphor coated and to color the fluorescent layer are employed in mammographic high sharpness screens for the purpose of improving the sharpness, but are undesirable because the X-ray quantum number effectively utilized in image formation is reduced. As mentioned above, the screen is desired to absorb more X-rays and to deliver more light emission from the phosphor upon X-ray absorption. The radiance of the screen is defined as a measure representing this efficiency.

The radiance of the screen is defined using the following silver halide photosensitive material. Since the screen of the invention uses a phosphor consisting essentially of $Gd_2O_2S$:Tb, it produces light emission having a main peak at 545 nm. Then a photographic silver halide photosensitive material which is color sensitized to light of this wavelength is used. A mammographic orthochromatic sensitized film having a silver halide emulsion layer coated on one surface of a support may be any of films commercially available from photographic material manufacturers. Prior to use, the photosensitive material is measured for sensitivity by the following procedure.

For the exposure of a photographic silver halide photosensitive material, a light source is used in the form of a tungsten light source (color temperature: 2856° K) combined with a transmissive filter having a transmission peak wavelength of 545 nm and a half-value width of 20 nm. The light source emits monochromatic light whose illuminance is correctly measured by a previously calibrated illuminometer. The photosensitive material is exposed to the monochromatic light through a step wedge of a neutral density filter for 1 second from a distance of 1 meter. The photosensitive material is then developed, fixed and dried to provide an optical density. The sensitivity of this photosensitive material is given by an exposure necessary to provide an optical density having a value of the minimum density (fog) plus 1.0. When the sensitivity of a photosensitive material is used to define the radiance of the screen, a mammographic one-side photographic silver halide photosensitive material having a sensitivity providing an exposure of 0.0210 lux-sec. is used. Where a measurement deviates from this value, the deviation is corrected on use. One typical example of the photosensitive material which can be used herein is UMMA-HC film manufactured by Fuji Photo-Film Co., Ltd. When a UMMA-HC #919-01 film manufactured by Fuji Photo-Film Co., Ltd. was developed by the developing process described below and measured for sensitivity, a sensitivity of 0.0210 lux-sec. was obtained.

Developing process

Using a developer (G) and a fixer (F) of the compositions shown below and a roller feed system automatic processor, a photosensitive material is processed under conditions: a developing temperature of 35°C., a developing time of 25 sec. (in liquid 21 sec.+out of liquid 4 sec.), a fixing time of 20 sec. (in liquid 16 sec.+out of liquid 4 sec.), a washing time of 12 sec., and a squeezing and drying time of 26 sec. More specifically, the roller feed system automatic processor used is an automatic processor FPM-5000 commercially available from Fuji Photo-Film Co., Ltd. which has built therein a developing tank with a volume of 22 liters at a temperature of 35° C. and a fixing tank with a volume of 15.5 liters at a temperature of 25° C.

| Developer (G): | |
|---|---|
| potassium hydroxide | 21 g |
| potassium sulfite | 63 g |
| boric acid | 10 g |
| hydroquinone | 25 g |
| triethylene glycol | 20 g |
| 5-nitroindazole | 0.2 g |
| glacial acetic acid | 10 g |
| 1-phenyl-3-pyrazolidone | 1.2 g |
| 5-methylbenzotriazole | 0.05 g |
| glutaraldehyde | 5 g |
| potassium bromide | 4 g |
| The developer (G) is diluted with water to a total volume of 1 liter and adjusted to pH 10.2. | |
| Fixer (F): | |
| ammonium thiosulfate (70 w/v %) | 200 ml |
| sodium sulfite | 20 g |
| boric acid | 8 g |
| disodium ethylenediaminetetraacetate (dihydrate) | 0.1 g |
| aluminum sulfate | 15 g |
| sulfuric acid | 2 g |
| glacial acetic acid | 22 g |

The fixer (F) is diluted with water to a total volume of 1 liter and adjusted to pH 4.5 by adding sodium hydroxide or glacial acetic acid if necessary.

Using the photosensitive material having a sensitivity of 0.0210 lux-sec., the radiance of a screen is measured as follows.

After the photosensitive material (a UMMA-HC #919-01 film by Fuji Photo-Film Co., Ltd.) is placed in close contact with the screen, exposure is made by irradiating X-rays from the photosensitive material side. As the X-ray source, a molybdenum target tube is operated with a three-phase power supply at 26 kVp to emit X-rays which are transmitted by a Be filter of about 1 mm thick, a Mo filter of 0.03 mm thick, and an acrylic filter of 2 cm thick. The exposure time is the same as used in the definition of the photosensitive material. That is, exposure is made for about 1 second. The X-ray exposure dose is measured at the same time using an ionization dosimeter.

The exposed photosensitive material is subject to the same developing process as used in the definition of the sensitivity of photosensitive material. By appropriately changing the current flow of the X-ray tube and the exposure time between 0.5 sec. and 1.5 sec. and repeating this procedure, the X-ray exposure dose is determined which ensures that the developed photosensitive material has an optical density of the fog+1.0. The reciprocal of this exposure dose is defined as the radiance of the screen. For data descriptive purpose, the radiance (=0.139 $mR^{-1}$) of the screen having an exposure dose of 7.2 mR is expressed 100 as a standard basis.

More illustratively, a commercially available screen UM Mammo Fine (Kasei Optonix K.K.) was measured for radiance by this procedure, finding a radiance of 0.139 $mR^{-1}$. That is, the radiance of this screen corresponds to 100. The radiance of other commercially available screens is shown in Example 2.

As the X-ray generator for use in this measurement, a commercially available mammographic machine may be used. For this measurement, a mammographic apparatus DRX-B1356EC by Toshiba K.K. is used throughout this specification. The Mo filter used is one originally built in the machine, and an acrylic filter of 2 cm thick is set about 20 cm apart from the tube. The distance between the radiation source and the screen surface is about 60 cm.

As the dosimeter, a commercially available ionization type dosimeter for lower energy X-rays may be used. An ionization dosimeter Model mdh1015C and an ion chamber 10×5-6M by Radical Corporation are used throughout this specification. The dose of X-rays actually irradiated to the film/screen pair is measured by incorporating corrections associated with the dose measurement position and the actual screen position, corrections associated with temperature and ambient pressure, and a correction associated with the absorption of the cassette top plate.

The screen suitable for use in combination with the photosensitive material of the invention has a radiance of 150 to 250 as measured by the above-mentioned procedure. More preferably the radiance is 160 to 240, most preferably 170 to 240.

As previously described, the radiance of the screen is in approximate proportion to the utilization efficiency of X-rays. In order to effectively utilize X-rays, it is preferred that the fluorescent layer of the screen is substantially uncolored or undyed. The substantial uncoloring of the screen fluorescent layer means that the screen has a radiance of 80 to 100% of the radiance of a screen which is not colored with coloring dyes or pigments at all.

Now reference is made to the sharpness of the preferred screen used herein. We have found that the intensifying screen for use in the mammographic system should have a sharpness or contrast transfer function (CTF) of 0.40 to 1.00, preferably 0.45 to 1.00 at a spatial frequency of 5 lp/mm.

It is described how to measure a sharpness. Upon sharpness measurement, a mammographic photosensitive material having a silver halide emulsion layer coated only on one surface of a support may be used. Of course, a water-soluble dye is coated on the back surface of the photosensitive material for anti-halation purpose as is well known in the art. In the practice of the invention, a UMMA-HC one-side photosensitive material manufactured by Fuji Photo-Film Co., Ltd. is used. The photosensitive material is placed in close contact with an intensifying screen to be measured for sharpness, and a mammographic ECMA cassette by Fuji Photo-Film Co., Ltd. was loaded with this combination. A rectangular chart for modulation transfer function (MTF) measurement (Kasei Optonix K.K., Type 9, Sn, gage: 40 $\mu$m, spatial frequency: 0 to 10 lp) is placed in close contact with the cassette whereupon photographing is carried out. The MTF chart and cassette are spaced 60 cm from the X-ray tube, and the components are set relative to the X-ray tube so as to arrange the X-ray tube, MTF chart, cassette top plate, film, and intensifying screen in the described order. The X-ray source used is the same as used in the measurement of the radiance of the screen. The X-ray tube has a nominal focus size of 0.4 mm.

As described above, the acrylic filter is spaced 20 cm from the tube focus and the distance from the acrylic filter to the X-ray chart and screen is as long as 40 cm. These sufficient distances ensure that exposure is made while minimizing the mixing of scattered radiation.

The exposed film is developed by the same developing process as used in the measurement of the radiance of the screen. By adjusting the exposure time, the photographed sample is adjusted such that a high density portion has a density of 1.8. Such adjustment makes it possible to use a straight line portion of the characteristic curve of the photosensitive material.

The chart as developed is scanned by means of a microdensitometer. Using a slit having an aperture of 30 $\mu$m in a scanning direction and 500 $\mu$m in a transverse direction, a density profile is measured at a sampling spacing of 30 $\mu$m. After this procedure is repeated 20 times, an average is calculated. This constitutes an original density profile on the basis of which the CTF of a screen is calculated. Thereafter, the peak of a rectangular wave at each of frequencies in the density profile is detected whereupon the density contrast at each frequency is calculated. These data are standardized on the basis of the contrast at zero frequency, obtaining a contrast transfer function (CTF).

The fluorescent layer of the screen may have any desired thickness. A screen having a high sensitivity and high sharpness as mentioned above is advantageously realized particularly when the fluorescent layer has a thickness of 50 to 120 $\mu$m.

With respect to the detail of the screen used in the invention, reference should be made to JP-A 75097/1994 and 191237/1995.

Next, the screen/film combination is described.

The sensitivity of the combination of the photosensitive material with the screen has the preferred range. Preferred is a combination having such a sensitivity that the exposure dose of X-rays necessary to give an optical density of fog+1.0 is 4 to 10 mR, especially 6 to 9 mR, when exposure is made using X-rays which are emitted by a molybdenum target tube operated with a three-phase power supply at 26 kVp and transmitted by a Be filter of about 1 mm thick, a Mo filter of 0.03 mm thick, and an acrylic filter of 2 cm thick and Developing Process (1) is then carried out. The greater the necessary exposure dose, the lower sensitivity the system has. Inversely, a lower exposure dose indicates a higher sensitivity system. A low sensitivity system having an exposure dose of 10 mR or more is better because of low quantum noise, but undesirable on practical use because the patient is also exposed to an increased dose. A low exposure dose is set as a compromise between the patient exposure and the image quality and cannot be definitely determined. In general, as the sensitivity becomes higher, the graininess becomes worse, resulting in an obstacle to diagnosis.

Better results are obtained when the photosensitive material of the invention is set within the above-defined range provided that it is used in combination with the screen. As a reference, a combination system of a UM-Mammo Fine screen and a UMMA-HC film, both manufactured by Fuji Photo-Film Co., Ltd. has a sensitivity of 7.2 mR.

EXAMPLE

Examples of the invention are given below by way of illustration and not by way of limitation. Mw is an average molecular weight.

Example 1: Preparation and Rating of Photosensitive Material Emulsion

1. High Contrast Emulsion (a1) Having an Iodide Content of 2.8 mol %

To 1 liter of a 2 wt % gelatin solution containing 5.3 g of potassium bromide and 4 g of sodium para-toluenesulfinate were added 10 mg of sodium thiosulfate pentahydrate, 2.4 g of potassium thiocyanate, and 10 cc of glacial acetic acid. With vigorous stirring, 14 cc of an aqueous solution containing 5.1 g of silver nitrate and 7 cc of an aqueous solution containing 1.8 g of potassium bromide and 0.08 g of potassium iodide were added to the solution by the double jet method. Thereafter, 30 cc of an aqueous solution containing 3 g of potassium iodide was added thereto.

To the thus obtained solution, 200 cc of an aqueous solution containing 78.1 g of silver nitrate was first added over 15 minutes and after 1 minute, 200 cc of an aqueous solution containing 50.6 g of potassium bromide and 2.3 g of potassium iodide was added over 15 minutes. Next, 7.8 cc of 25 wt % aqueous ammonia was added to the solution, which was ripened for 10 minutes. To the solution, an aqueous solution containing 117 g of silver nitrate and an aqueous solution containing 82.3 g of potassium bromide were simultaneously added over 14 minutes. Throughout the process, the reaction solution was maintained at a temperature of 70° C.

The reaction solution was washed by a conventional flocculation method, gelatin, a thickener, and an antiseptic agent were added and dispersed at 40° C., and the solution was then adjusted to pH 5.6 and pAg 8.9. While the reaction solution was maintained at 57° C., 216 mg of 4-hydroxy-6-methyl-1,3,3a,7-tetraazaindene was added, and then 270 mg of Sensitizing Dye A (green sensitizing dye) shown below and 300 mg of Sensitizing Dye B (blue sensitizing dye) shown below added to the solution, which was ripened for 10 minutes. Then, 8.7 mg of sodium thiosulfate pentahydrate, 54 mg of potassium thiocyanate, and 3.1 mg of chloroauric acid were successively added to the solution, which was ripened for 60 minutes. Then, 690 mg of 4-hydroxy-6-methyl-1,3,3a,7-tetraazaindene and 5.1 cc of a 10% aqueous solution of potassium iodide were added to the solution, which was cooled. There was obtained a fine non-tabular grain emulsion (a1) having a mean grain size of 0.65 μm.

Green Sensitizing Dye A

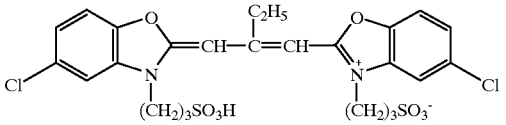

Blue Sensitizing Dye B

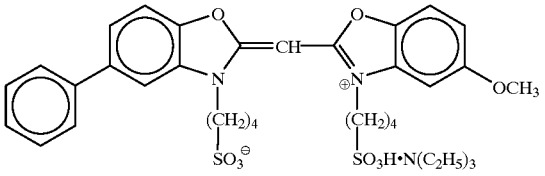

2. Monodisperse High Contrast Emulsion (b1) Having an Iodide Content of 0.13 mol %

To 1 liter of a 4 wt % gelatin solution containing 0.064 g of potassium bromide and 0.04 g of sodium para-toluenesulfinate were added 7 mg of sodium thiosulfate pentahydrate, 1.5 cc of glacial acetic acid, and 6.5 cc of 25 wt % aqueous ammonia. With vigorous stirring at 65° C., 600 cc of an aqueous solution containing 203 g of silver nitrate and 630 cc of an aqueous solution containing 180 g of potassium bromide and Rhodium Compound R in an amount relative to silver as shown in Table 1 were added at a constant rate over 55 minutes by the double jet method. Thereafter, 25 cc of an aqueous solution containing 0.25 g of potassium iodide was added to the solution, which was ripened for 5 minutes.

The reaction solution was washed by a conventional flocculation method, gelatin, a thickener, and an antiseptic agent were added and dispersed at 40° C., and the solution was then adjusted to pH 5.6 and pAg 8.2. While the reaction solution was maintained at 57° C., $1\times10^{-5}$ mol per mol of silver of Thiosulfonic Acid Compound T was added, and 300 mg of Sensitizing Dye A and 300 mg of Sensitizing Dye B added to the solution, which was ripened for 10 minutes. Then, 6 mg of sodium thiosulfate pentahydrate, 1.7 mg of Selenium Sensitizer S, 3.1 mg of chloroauric acid, and 54 mg of potassium thiocyanate were successively added to the solution, which was ripened for 70 minutes. There was obtained a monodisperse fine cubic grain emulsion (b1) having a mean grain size of 0.48 μm and a coefficient of variation of 13%.

The compounds used herein have the following structural formulae.

Rh Compound R $K_3RhBr_6$

Thiosulfonic Acid Compound T $C_2H_5SO_2SNa$

Green Sensitizing Dye A

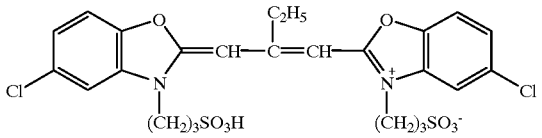

Blue Sensitizing Dye B

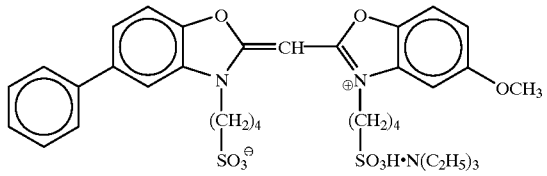

Selenium Sensitizer S

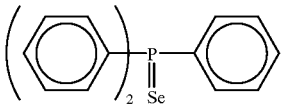

3. Monodisperse High Contrast Tabular Emulsion (c1) Having an iodide Content of 0.1 mol %

To 1 liter of a solution containing 0.4 g of potassium bromide and 0.5 g of low molecular weight gelatin (average molecular weight less than 20,000) which was kept at 40° C., with vigorous stirring, 20 cc of an aqueous solution containing 1.5 g of silver nitrate and 20 cc of an aqueous solution containing 1.05 g of potassium bromide and 0.4 g of the low molecular weight gelatin were added over 40 seconds. An aqueous solution containing 2.2 g of potassium bromide was then added and the temperature was raised from 40° C. to 75° C. over 40 minutes. At the end of heating, 350 cc of a 10% gelatin solution was added. Thereafter, 735 cc of an aqueous solution containing 165 g of silver nitrate and an aqueous solution of potassium bromide having added Rhodium Compound R in an amount as shown in Table 1 were added to the solution which was kept at pBr=2.42. It is noted that the silver nitrate aqueous solution was entirely added at an initial rate of 30 cc/min. over 40 minutes. An aqueous solution containing 3 g of potassium thiocyanate was then added to the solution, which was ripened for 5 minutes. The reaction solution was washed by a conventional flocculation method, gelatin, a thickener, and an antiseptic agent were added and dispersed at 40° C., and the solution was then adjusted to pH 5.9 and pAg 7.8. While the reaction solution was maintained at 56° C., $1\times10^{-5}$ mol per mol of silver of Thiosulfonic Acid Compound T was added, AgI fine particles added in an amount of 0.1 mol % based on the total moles of silver, and 0.043 mg of thiourea dioxide added to the solution, which was kept at the temperature for 22 minutes for effecting reduction sensitization. Then 30 mg of 4-hydroxy-6-methyl-1,3,3a,7-tetraazaindene and 700 mg of Sensitizing Dye A were added. After the solution was ripened for 10 minutes, 0.83 g of calcium chloride was added. Then, 3 mg of sodium thiosulfate pentahydrate, 2.5 mg of Selenium Sensitizer S2, 3.1 mg of chloroauric acid, and 54 mg of potassium thiocyanate were successively added to the solution, which was ripened for 40 minutes. There was obtained a monodisperse fine tabular grain emulsion (c1) having a mean projection area diameter of 0.7 $\mu$m, a coefficient of variation of 14%, and an aspect ratio of 7.2.

The compounds used herein have the following structural formulae.

Rh Compound R $K_3RhBr_6$

Thiosulfonic Acid Compound T $C_2H_5SO_2SNa$

Green Sensitizing Dye A

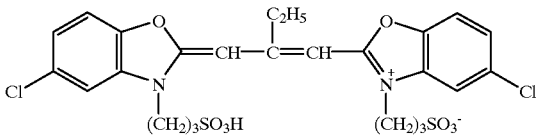

Selenium Sensitizer S2

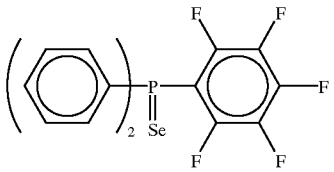

4. Coating Solution

Emulsion layer coating solutions were prepared by adding the following chemicals to the emulsions (a1) and (b1). Also a protective layer coating solution was prepared.

Emulsion Coating Solution

Emulsion (a1) or (b1) 1 kg (gelatin 81 g, Ag 92 g)
Polymer latex: poly(ethyl acrylate/methacrylic acid)=97/3 weight ratio 2.9 g
Hardener: 1,2-bis(vinylsulfonylacetamide)-ethane 1.1 g
2,6-bis(hydroxyamino)-4-diethylamino-1,3,5-triazine 0.04 g
Dextran (Mw 39,000) 10 g
Toe-cutting agent 0.34 g
p-hydroquinone potassium sulfonate5.4 g
Potassium iodide 0.05 g
Polyethylene oxide compound W 0.12 g
Mercapto compound M 0.05 g
Distilled water to make total volume 1160 ml The compounds used herein have the following structural formulae.

Toe-cutter agent

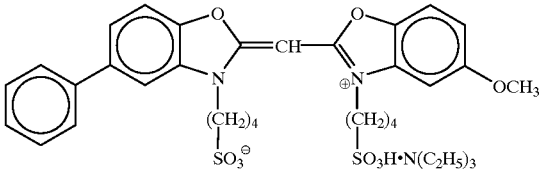

Polyethylene oxide compound W

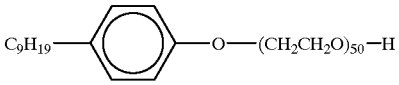

Mercapto compound M

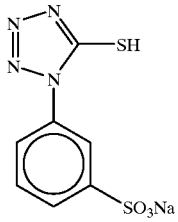

Protective Layer Coating Solution

Gelatin 1 kg
$C_{16}H_{33}O(CH_2CH_2O)_{10}H$ 27 g
$C_8F_{17}SO_2N(C_3H_7)(CH_2CH_2O)_4(CH_2)_4SO_3Na$ 1.4 g
$C_8F_{17}SO_2N(C_3H_7)(CH_2CH_2O)_{15}H$ 0.92 g
Polymethyl methacrylate particles 69 g (mean particle size 2.5 $\mu$m)
Proxel (Imperial Chemical Industries PLC) 0.7 g
Sodium polyacrylate (Mw 41,000) 19 g
Polystyrene sodium sulfonate (Mw 600,000) 10.5 g
NaOH 3.2 g
$C_8H_{17}C_6H_4(OCH_2CH_2)_3SO_3Na$ 16.2 g
Mercapto compound M2 1 g
Compound C 0.5 g
Distilled water to make total volume 11.1 liters The compounds used herein have the following structural formulae.

Mercapto compound M2

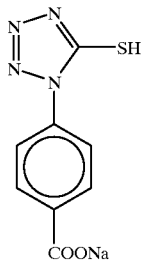

-continued

Compound C

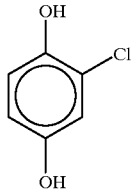

Antihalation Layer Coating Solution (1) Preparation of Dye Dispersion L

A solution containing 2.5 g of Dye-1, 2.5 g of Oil-I, and 2.5 g of Oil-II in 50 cc of ethyl acetate was mixed with 90 g of a 8% gelatin aqueous solution containing 1.5 g of sodium dodecylbenzenesulfonate and 0.18 g of methyl p-hydroxybenzoate at 60° C. and agitated at a high speed by a homogenizer. At the end of high speed agitation, the solution was transferred to an evaporator which was operated under vacuum at 60° C. to remove 92% by weight of the ethyl acetate. There was obtained a dye dispersion L having a mean particle size of 0.18 μm.

(2) Preparation of Coating Solution

Gelatin 1 kg

Polymer latex: poly(ethyl acrylate/methacrylic acid)=97/3 weight ratio 130 g

Phosphoric acid 1.23 g

Snowtex C (Nissan Chemical Industry K.K.) 120 g

Proxel 0.4 g

Dye dispersion L 190 g

Dye-2 18 g

Dye-3 12.5 g

Dye-4 13 g

Hardener: 1,2-bis(vinylsulfonylacetamide)-ethane 17.5 g

Distilled water to make total volume 13.8 liters

The compounds used herein have the following structural formulae.

Dye-1

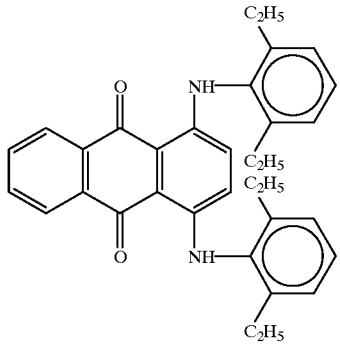

-continued

Dye-2

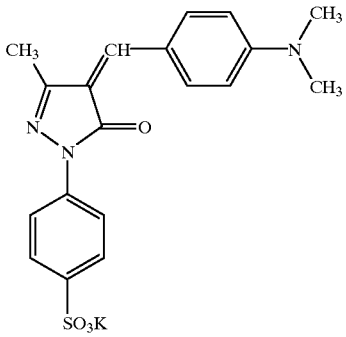

Dye-3

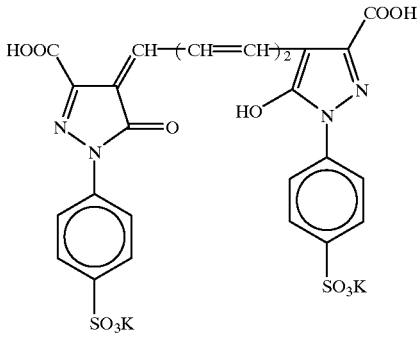

Dye-4

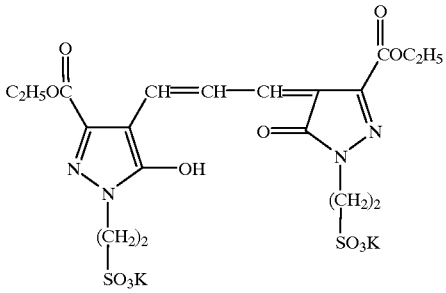

Oil-I

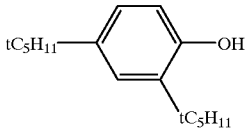

Oil-II

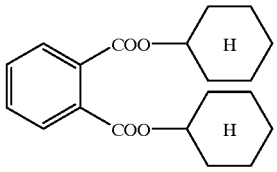

Back Protective Layer Coating Solution

Gelatin 1 kg $C_{16}H_{33}O(CH_2CH_2O)_{10}H$ 33 g $c_8F17SO_2N(C_3H_7)$ $(CH_2CH_2O)_4$ $(CH_2)_4SO_3Na$ 1.4 g $C_8F_{17}SO_2N(C_3H_7)$ $(CH_2CH_2O)_{15}H$ 0.92 g Polymethyl methacrylate particles 34 g (mean particle size 3.7 μm)

Proxel 0.7 g

Sodium polyacrylate (Mw 41,000) 75 g

Polystyrene sodium sulfonate (Mw 600,000) 10.5 g

NaOH 2.3 g
$C_8H_{17}C_6H_4$ $(OCH_2CH_2)_3SO_3Na$ 20 g
Distilled water to make total volume 10.7 liters
4. Photosensitive Material Photosensitive Material A The coating solutions prepared in Section 3 were coated on one surface of a undercoated PET support of 175 μm thick by the co-extrusion method, forming emulsion layers and a protective layer. The protective layer was the uppermost layer, the emulsion (b1) was below the protective layer or an upper emulsion layer, and the emulsion (a1) was the lowermost layer or a lower emulsion layer. The amount of gelatin in the protective layer was 0.6 g/m$^2$. Drying completed the photosensitive material. The coverage of the emulsion layer was determined to give a silver coverage as shown in Table 1. On the opposite side to the photosensitive layer, an antihalation dye layer and a protective layer were coated so as to give a gelatin coverage of 3.9 g/m$^2$ and 1.27 g/m$^2$, respectively.

Photosensitive Materials B through M

An emulsion (a2) having a grain size of 0.45 μm was prepared by the same procedure as emulsion (a1) except that the grain forming temperature was 58° C., the amount of potassium thiocyanate used during grain formation was changed to 1.6 g, and the amounts of the chemical sensitizers were adjusted.

Emulsions (b2), (b3) and (b4) were prepared by the same procedure as emulsion (b1) except that Rhodium Compound R was added to the halide solution during grain formation in an amount as shown in Table 1.

Emulsions (b5) to (b7) were prepared by the same procedure as emulsion (b1) except that iodine was introduced during grain formation, thereby changing the iodine content of the silver halide emulsion.

Emulsion (c2) was prepared by the same procedure as emulsion (c1) except that the pBr during nucleation and the pBr during grain formation were changed. Emulsion (c2) was a tabular grain emulsion having a mean projection area diameter of 0.73 μm, a coefficient of variation of 18%, and an aspect ratio of 9.0.

Photosensitive materials B through M were prepared by the same procedure as photosensitive material A while changing the emulsion as shown in Table 1.

For the purpose of evaluating each of the emulsions, a sample was formed by coating each emulsion as a single layer. The emulsion was determined for sensitivity which is expressed by logE wherein E is an exposure.

Photosensitive materials A through M are summarized in Table 1.

TABLE 1

| | Upper layer emulsion | | | | |
|---|---|---|---|---|---|
| Photosensitive material | Emulsion No. | Iodine content (mol %/mol Ag) | Coefficient of variation of grain size (%) | Amount of Rh added (mol %/mol Ag) | Amount of Ag coated (g/m$^2$) |
| A | b1 | 0.13 | 11 | $2.5 \times 10^{-8}$ | 2.1 |
| B | a2 | 2.8 | 28 | — | 2.1 |
| C | b2 | 0.13 | 12 | — | 2.1 |
| D | b1 | 0.13 | 11 | $2.5 \times 10^{-8}$ | 4.2 |
| E | a1 | 2.8 | 26 | — | 2.1 |
| F | b3 | 0.13 | 11 | $4 \times 10^{-8}$ | 2.1 |
| G | b4 | 0.13 | 11 | $7 \times 10^{-8}$ | 2.1 |
| H | b4 | 0.13 | 11 | $7 \times 10^{-8}$ | 2.1 |
| I | b5 | 0.25 | 12 | $2.5 \times 10^{-8}$ | 2.1 |
| J | b6 | 0.7 | 13 | $2.5 \times 10^{-8}$ | 2.1 |
| K | b7 | 1.2 | 13 | $2.5 \times 10^{-8}$ | 2.1 |
| L | b1 | 0.13 | 11 | $2.5 \times 10^{-8}$ | 2.1 |
| M | b1 | 0.13 | 11 | $2.5 \times 10^{-8}$ | 2.1 |

| | Lower layer emulsion | | | | | Upper layer |
|---|---|---|---|---|---|---|
| Photo-sensitive material | Emulsion No. | Iodine content (mol %/mol Ag) | Coefficient of variation of grain size (%) | Amount of Rh added (mol %/mol Ag) | Amount of Ag coated (g/m$^2$) | emulsion sensitivity -lower layer emulsion sensitivity (log E) |
| A | a1 | 2.8 | 26 | — | 2.1 | −0.2 |
| B | a1 | 2.8 | 26 | — | 2.1 | −0.25 |
| C | a1 | 2.8 | 26 | — | 2.1 | −0.3 |
| D | — | — | — | — | — | 0 |
| E | b1 | 0.13 | 11 | $2.5 \times 10^{-8}$ | 2.1 | +0.2 |
| F | a1 | 2.8 | 26 | — | 2.1 | −0.1 |
| G | a1 | 2.8 | 26 | — | 2.1 | +0.2 |
| H | a2 | 2.8 | 28 | — | 2.1 | −0.05 |
| I | a1 | 2.8 | 28 | — | 2.1 | −0.2 |
| J | a1 | 2.8 | 28 | — | 2.1 | −0.2 |
| K | a1 | 2.8 | 28 | — | 2.1 | −0.2 |
| L | c1 | 0.05 | 14 | $1.8 \times 10^{-8}$ | 1.7 | −0.2 |
| M | c2 | 0.05 | 18 | $1.8 \times 10^{-8}$ | 1.5 | −0.3 |

Measurement of Sensitivity and Gradation

The sensitivity of a photosensitive material or film was determined by combining it with a commercially available UM-Mammo Fine screen and effecting X-ray exposure. Measurement was done by changing the X-ray exposure by the distance method. Since this measurement used the same screen and exchanged only the photosensitive material, the results were the same as obtained when exposure was made using an actual mammographic molybdenum target tube.

More specifically, a tungsten target tube was operated with a three-phase power supply at 50 kVp to generate X-rays which were transmitted by an aluminum plate of 3 mm thick. A photosensitive material or film to be measured was placed in close contact with a commercially available screen UM-Mammo Fine. An ECMA cassette by Fuji Photo-Film Co., Ltd. was loaded with this combination. After the cassette was set relative to the X-ray tube so as to arrange the X-ray tube, the cassette top plate, the film, and the screen in the described order, the film was exposed to X-rays. While an X-ray exposure E was changed by the distance method, step exposure was done at a width of logE=0.15.

Using a commercially available automatic processor FPM-5000 (Fuji Photo-Film Co., Ltd.), the exposed film was developed with the developer (G) at 35° C. for 25 seconds (total processing time 83 seconds). Other conditions are the same as in DETAILED DESCRIPTION OF THE INVENTION section. The fixer used was the aforementioned fixer (F) and city water was used for washing. The developed film was measured for optical density. The sensitivity of the film was a reciprocal of an exposure necessary to provide an optical density of fog+1.0. It is noted that the sensitivity is expressed as a relative value to a sensitivity of 100 for UMMA-HC film in which a light quantity of 0.0210 lux-sec. provides a density of fog+1.0 when exposed to monochromatic light of 545 nm±20 nm.

The contrast of a film was determined according to the aforementioned definition as the gradient of a straight line connecting density points of fog+0.25 and fog+2.0. The results are shown in Table 2. It is noted that Table 2 reports the data of commercially available UMMA-HC film by Fuji Photo-Film Co., Ltd. as well as photosensitive materials A through M.

The developer (G) was allowed to stand at 35° C. for 7 days whereby it was oxidized and deteriorated, resulting in an exhausted developer (G2). Using exhausted developer (G2) instead of developer (G), the film was determined for sensitivity and gradation by the same methods. The results are shown in Table 2. Developer (G2) was analyzed to find that hydroquinone had been reduced to 7 g/liter.

The following conclusions are derived from Tables 1 and 2.

1. The photosensitive material of the invention wherein at least one emulsion layer has an iodide content of less than 0.9 mol % achieves a satisfactory sensitivity and gradation even when processed with developer (G2) which is an oxidized, deteriorated solution. There is obtained a photosensitive material exhibiting a minimal variation of sensitivity and gradation for a change of developer. For a high contrast photosensitive material as used herein, the stability of sensitivity and gradation is a very important factor.

A photosensitive material exhibiting more stability is obtained when at least one emulsion layer has an iodide content of less than 0.3 mol %.

2. A two-layer construction having a finer grain, low sensitivity emulsion as an upper layer provides improved contrast over a single-layer construction wherein upper and lower layers have the same sensitivity. A high contrast photosensitive material as intended herein is more readily prepared.

3. A desirable higher contrast photosensitive material is obtained by doping a silver halide emulsion with $1\times10^{-8}$ to $5\times10^{-8}$ mol of rhodium per mol of silver. More than $5\times10^{-8}$ mol of rhodium per mol of silver undesirably detracts from sensitivity.

4. A higher contrast is obtained when the grain size distribution of silver halide is more monodisperse.

Measurement of Roller Marks and Residual Color

After the respective photosensitive materials were uniformly photo-exposed to a density of 0.5, they were processed by means of the automatic processor in the same manner as in the measurement of sensitivity and gradation. The developed films were observed to examine roller marks in the form of black spots and rated according to the following criterion.

○: few roller marks found

TABLE 2

| Photo-sensitive material | Upper layer emulsion Emulsion No. | Upper layer emulsion Iodine content (mol %/mol Ag) | Lower layer emulsion Emulsion No. | Lower layer emulsion Iodine content (mol %/mol Ag) | Developing process(1) Gradation | Developing process(1) Sensitivity | Developing process(2) Gradation | Developing process(2) Sensitivity (fatigue) |
|---|---|---|---|---|---|---|---|---|
| A* | b1 | 0.13 | a1 | 2.8 | 4.2 | 100 | 4.0 | 95 |
| B** | a2 | 2.8 | a1 | 2.8 | 4.0 | 100 | 2.9 | 75 |
| C* | b2 | 0.13 | a1 | 2.8 | 3.8 | 100 | 3.7 | 90 |
| D* | b1 | 0.13 | — | — | 3.8 | 80 | 3.7 | 75 |
| E** | a1 | 2.8 | b1 | 0.13 | 2.6 | 120 | — | — |
| F* | b3 | 0.13 | a1 | 2.8 | 4.0 | 90 | 3.9 | 85 |
| G** | b4 | 0.13 | a1 | 2.8 | 3.2 | 80 | — | — |
| H* | b4 | 0.13 | a2 | 2.8 | 4.3 | 60 | 4.1 | 57 |
| I* | b5 | 0.25 | a1 | 2.8 | 4.1 | 100 | 3.9 | 90 |
| J* | b6 | 0.7 | a1 | 2.8 | 4.3 | 100 | 3.7 | 90 |
| K** | b7 | 1.2 | a1 | 2.8 | 4.4 | 100 | 3.3 | 80 |
| L* | b1 | 0.13 | c1 | 0.05 | 3.8 | 100 | 3.8 | 95 |
| M** | b1 | 0.13 | c2 | 0.05 | 3.6 | 110 | 3.4 | 100 |
| UMMA-HC (Fuji Photo Film Co., Ltd.)** | | | | | 3.6 | 180 | 3.2 | 150 |

*Invention
**Comparison

Measurement of Sensitivity and Gradation Using Exhausted Developer

Δ: acceptable some roller marks

X: many roller marks found

The results are shown in Table 3.

Next, the residual color, that is, the sensitizing dye left in a developed film was examined by the following method. First, an unexposed film was processed by the automatic processor in the same manner as in the measurement of sensitivity and gradation. The conditions in winter under which residual color is likely to occur were simulated by lowering the temperature of washing water to 10° C. The processed film was visually observed for color and rated according to the following criterion.

○: little residual color found

Δ: acceptable slight residual color

X: noticeable residual color

The results are shown in Table 3.

TABLE 3

| Photo-sensitive material | Upper layer emulsion Emulsion No. | Upper layer emulsion Iodine content (mol %/mol Ag) | Lower layer emulsion Emulsion No. | Lower layer emulsion Iodine content (mol %/mol Ag) | Developing process(1) Gradation | Roller mark | Residual color |
|---|---|---|---|---|---|---|---|
| A* | b1 | 0.13 | a1 | 2.8 | 4.2 | ○ | ○ |
| B** | a2 | 2.8 | a1 | 2.8 | 4.0 | X | X |
| C* | b2 | 0.13 | a1 | 2.8 | 3.8 | ○ | ○ |
| D* | b1 | 0.13 | — | — | 3.8 | ○ | ○ |
| E** | a1 | 2.8 | b1 | 0.13 | 2.6 | ○ | ○ |
| F* | b3 | 0.13 | a1 | 2.8 | 4.0 | ○ | ○ |
| G** | b4 | 0.13 | a1 | 2.8 | 3.2 | ○ | ○ |
| H* | b4 | 0.13 | a2 | 2.8 | 4.3 | ○ | ○ |
| I* | b5 | 0.25 | a1 | 2.8 | 4.1 | ○ | ○ |
| J* | b6 | 0.7 | a1 | 2.8 | 4.3 | Δ | Δ |
| K** | b7 | 1.2 | a1 | 2.8 | 4.4 | Δ | X |
| L* | b1 | 0.13 | c1 | 0.05 | 3.8 | ○ | ○ |
| M** | b1 | 0.13 | c2 | 0.05 | 3.6 | ○ | ○ |
| UMMA-HC (Fuji Photo Film Co., Ltd.)** | | | | | 3.6 | ○ | ○ |

*Invention

**Comparison

It is evident from Table 3 that a photosensitive material having a low iodine content according to the invention is advantageous in that the appearance of roller marks and residual color which can disturb diagnosis is 5 minimized.

Example 2: Preparation of Intensifying Screen

Described below is an intensifying screen which is advantageously used in combination with the photosensitive material of the invention.

(1) Carbon Black Undercoat Layer

To methyl ethyl ketone were added 40 g of carbon black powder and 80 g of Binder C (Criscoat P1018Gs by Dai-Nihon Ink Chemical Industry K.K.). They were mixed and dispersed to form an undercoat layer coating solution having a viscosity of 3 poise. The coating solution was uniformly applied to a transparent PET support of 350 μm thick by means of a doctor blade and dried to form an undercoat layer of 20 μm thick. This undercoat layer had sufficient light shielding ability and good surface smoothness.

(2) Support with titanium dioxide light reflective layer

To methyl ethyl ketone were added 500 g of rutile type $TiO_2$ powder having a mean particle size of 0.28 μm (CR95 by Ishihara Industry K.K.) and 100 g of Binder C (Criscoat P1018Gs by Dai-Nihon Ink Chemical Industry K.K.). They were mixed and dispersed to form an undercoat layer coating solution having a viscosity of 10 poise. The mixing ratio of the binder to $TiO_2$ particles was ⅕ in weight ratio. The coating solution was uniformly applied to a transparent PET support of 250 μm thick by means of a doctor blade and dried to form a reflective layer of 35 μm thick. No agglomeration of $TiO_2$ particles was found in the reflective layer which had good surface smoothness. The reflective layer was measured for diffuse reflectance at 545 nm which is the main emission peak of the phosphor, finding a diffuse reflectance of 94%. The reflective layer was thus found to have sufficiently high reflectance and reflection sharpness.

(3) Fluorescent Layer

A coating solution for forming a fluorescent sheet was prepared by adding 250 g of a phosphor ($Gd_2O_2S$:Tb, mean particle size 2 μm as expressed by a mean diameter of equivalent sphere by electron microscopy), 6 g as solids of Binder A (polyurethane, trade name Desmorack TPKL-5-2625 by Sumitomo Bayern Urethane K.K.), 1 g of Binder B (Epikoat 1001 by Yuka Shell Epoxy K.K.), and 0.5 g of an isocyanate (Colonate HX by Nippon Polyurethane K.K.) to methyl ethyl ketone. They were dispersed by means of a propeller mixer, obtaining a dispersion having a viscosity of 20 poise at 25° C. This coating solution was coated on a temporary support (a PET support having a silicone release agent precoated thereon), dried, and peeled from the temporary support, obtaining a fluorescent layer. The fluorescent layer was 125 μm thick.

(4) Fluorescent Screen

The fluorescent layer of (3) was rested on the support having the undercoat layer coated thereon in (1). They were pressed under 400 kgw/cm$^2$ at 80° C. by means of a calender roll, obtaining a fluorescent sheet without a protective layer. At the end of calendering, the fluorescent layer had a thickness of 105 μm and a phosphor packing factor of 68% by volume.

(5) Surface Protective Layer

A protective layer coating solution was prepared by dissolving 10 g of a fluoro-resin (Lumifron LF100 by Asahi Glass K.K.), 1.5 g of an alcohol-modified siloxane oligomer (X-22-2809 by Shin-Etsu Chemical Industry K.K.), 3.2 g of an isocyanate (Olestar NP38-70S by Mitsui Toatsu Chemical K.K.), and 0.001 g of a catalyst (KS1269 by Kyodo Pharmaceuticals K.K.) in a ⅓ (weight ratio) mixture of methyl ethyl ketone and cyclohexanone. This coating solution was coated onto the fluorescent sheet without a protective layer by means of a doctor blade, slowly dried, and heat treated at 120° C. for 10 minutes. A fluorescent sheet having a protective layer of 4 μm thick was obtained.

(6) Embossing

The fluorescent sheet was embossed by means of a stainless steel roller having randomly distributed projections. Embossing conditions included a linear pressure of 40 kg/cm, a temperature of 50° C., and a feed rate of 3 m/min.

(7) Stamping

On a stamping area of the surface of the fluorescent layer on which the protective layer had been coated, a PET film (mask film) having a slightly larger hole than the stamp mark was placed in close contact. Using a pinhole tester (Tesla coil K model, Tokyo High-Frequency Electric Furnace K.K.), discharge treatment was carried out under conditions: 25° C., RH 65%, distance 1 cm, and 3 seconds. An ink ribbon (BLACK-TP, Nakajima Metal Foil Industry K.K.) was stamped against the fluorescent sheet by means of a hot press under conditions: 100° C., 5 kg/cm$^2$, and 10 seconds.

In this way, a screen 2 having a fluorescent layer of 105 $\mu$m thick and a surface protective layer of 4 $\mu$m thick was prepared as shown in Table 4. Screens 1 to 4 were similarly prepared while changing the thickness of the fluorescent layer. Screens 5 to 9 were similarly prepared while changing the undercoat layer from the carbon black layer of (1) to the titanium dioxide reflective layer of (2). In these screens 1, 3, 4, and 5 to 9 too, the volume packing factor of phosphor was 68%.

Next, to demonstrate the effect of adding carbon black fine powder to the fluorescent layer as an agent for absorbing light emission, screens 10 and 11 were prepared by the same procedure as screen 2, by adding 0.0015% or 0.006% by weight based on the phosphor of carbon black to the fluorescent layer and calendering the fluorescent layer to a thickness of 100 $\mu$m. In these screens 10 and 11 too, the volume packing factor of phosphor was 68%.

Measurement of the Radiance of Screen

As described in DETAILED DESCRIPTION OF THE INVENTION section, the measurement of screen radiance was carried out using a one-side photographic silver halide photosensitive material which provides an optical density of fog+1.0 when exposed to monochromatic light of 545 nm±20 nm at an illuminance of 0.0210 lux for 1 second and developed under the conditions of Developing Process (1). Specifically, a UMMA-HC #919-01 film manufactured by Fuji Photo-Film Co., Ltd. was used. The film and the screen were mated such that the emulsion surface of the film was in close contact with the protective layer of the screen. An ECMA cassette by Fuji Photo-Film Co., Ltd. was loaded with this combination. After the cassette was set relative to the X-ray tube so as to arrange the X-ray tube, cassette top plate, film, and screen in the described order, the film was exposed to X-rays.

The X-ray source used was a commercially available mammographic apparatus DRX-B1356EC by Toshiba Corp. A molybdenum target tube was operated with a three-phase power supply at 26 kVp to emit X-rays which were transmitted by a Be filter of 1 mm thick, a Mo filter of 0.03 mm thick, and an acrylic filter of 2 cm thick. The distance between the radiation source and the screen surface was about 60 cm. In order to simultaneously measure the dose of X-rays irradiated to the film/screen pair, an ionization dosimeter Model mdh1015C and an ion chamber 10×5-6M by Radical Corporation were used. The dose of X-rays actually irradiated to the film/screen pair was measured by incorporating corrections associated with the dose measurement position and the actual screen position, corrections associated with temperature and ambient pressure, and a correction associated with the absorption of the cassette top plate.

By changing the current flow across the tube and the exposure time between 0.5 second and 1.5 seconds, the exposed dose with which the developed film exhibited a density of fog+1.0 was determined.

Using an automatic processor FPM-5000 (Fuji Photo-Film Co., Ltd.), the exposed film was processed by Developing Process (1). The developed film was measured for optical density. By plotting the density relative to the dose of irradiated X-rays, an exposed dose giving a film density of fog+1.0 was determined. A reciprocal of the exposed dose giving a density 1.0 was a measure representative of the radiance of the screen. As described in DETAILED DESCRIPTION OF THE INVENTION section, measurement was made using a commercially available UM-Mammo Fine screen by Kasei Optonix K.K. A film density of fog+1.0 was obtained with an exposed dose of 7.2 mR. This UM-Mammo Fine screen had a radiance of 0.139 mR$^{-1}$. The radiance of other screen was defined on the basis of a radiance of 100 for this screen. Table 4 summarizes the radiance of the screens prepared in this Example and several commercially available screens.

Measurement of CTF

A one-side photosensitive material UMMA-HC film by Fuji Photo-Film Co., Ltd. was placed in close contact with an intensifying screen to be measured for sharpness. A rectangular chart for modulation transfer function (MTF) measurement (Kasei Optonix K.K., Type 9, Sn, gage: 40 $\mu$m, spatial frequency: 0 to 10 lp) was photographed. The exposure conditions and arrangement were the same as in the measurement of screen radiance. The tube current was 100 mA and the X-ray tube had a nominal focus size of 0.4 mm. The MTF chart was placed at a spacing of 60 cm from the X-ray tube and in close contact with the cassette.

By setting the components such that the acrylic filter of 2 cm thick for quality adjustment was spaced 20 cm from the tube focus and the distance from the acrylic filter to the X-ray chart and screen was as long as 40 cm, the mixing of scattered radiation was prevented.

The photographed film was subjected to Developing Process (1) as used in the measurement of screen radiance by adjusting the exposure time such that a high density portion had a density of 1.8. Thereafter, a contrast transfer function (CTF) was determined as described in DETAILED DESCRIPTION OF THE INVENTION section. CTF values as measured at a spatial frequency of 5 lp/mm are shown in Table 4.

TABLE 4

| Screen | Undercoat layer | Fluorescent layer thickness (μm) | Amount of carbon black added*1 | Amount of phosphor coated (mg/cm²) | Screen radiance | CTF (5 lp/mm) |
|---|---|---|---|---|---|---|
| 1 | carbon black | 130 | 0% | 62 | 210 | 0.38 |
| 2 | carbon black | 105 | 0% | 52 | 200 | 0.46 |
| 3 | carbon black | 80 | 0% | 40 | 175 | 0.56 |
| 4 | carbon black | 60 | 0% | 28 | 140 | 0.61 |
| 5 | titanium dioxide | 130 | 0% | 65 | 240 | 0.36 |
| 6 | titanium dioxide | 85 | 0% | 45 | 200 | 0.42 |
| 7 | titanium dioxide | 65 | 0% | 30 | 190 | 0.48 |
| 8 | titanium dioxide | 50 | 0% | 26 | 165 | 0.59 |
| 9 | titanium dioxide | 30 | 0% | 15 | 125 | 0.64 |
| 10 | carbon black | 100 | 0.0015% | 50 | 140 | 0.57 |
| 11 | carbon black | 100 | 0.006% | 50 | 110 | 0.66 |
| S-1 | Kasei Optonix K. K., Fuji Photo Film Co., Ltd. UM-Fine | | | | 100 | 0.57 |
| S-2 | Kasei Optonix K. K., Fuji Photo Film Co., Ltd. UM-Medium | | | | 135 | 0.46 |
| S-3 | Eastman Kodak Co. Min-R | | | | 95 | 0.52 |
| S-4 | Eastman Kodak Co. Min-R-medium | | | | 140 | 0.41 |
| S-5 | Konica Corp. M-200 | | | | 170 | 0.36 |
| S-6 | Eastman Kodak Co. Min-R-Fast front | | | | 70 | 0.56 |
| S-7 | Eastman Kodak Co. Min-R-Fast back | | | | 135 | 0.39 |

*1% by weight based on the phosphor
S-1 to S-7 all used $Gd_2O_3S$:Tb.

As is evident from Table 4, the screens prepared in this Example surpass the commercial screens in radiance and CTF. It is seen that a screen having a high radiance and a CTF value of at least 0.40 at a spatial frequency of 5 lp/mm is advantageously accomplished when the fluorescent layer is not dyed and has a gage of 50 to 120 μm.

The following Example demonstrates that a combination of a screen having a CTF value of at least 0.40 at a spatial frequency of 5 lp/mm with the photosensitive material of the invention is useful particularly for mammography.

Example 3: Image Quality of Combination

A combination of a photosensitive material film of Example 1 with a screen of Example 2 was examined for detectivity by photographing a RMI-156 phantom serial No. 156-12438 by Gammex Co. For photographing, a voltage of 28 kVp and a grid were used. The result was rated according to the following criterion.

◎: clear view

○: fully detectable

Δ: vague view

X: poor view

Upon rating, (1) the detectivity of mass calcification fibers and (2) the detectivity of calcification margin (marginal detectivity) were also taken into account. The results are shown in Table 5.

TABLE 5

| Combination | Screen | Film | Contrast | Combination sensitivity | Detectivity | Marginal detectivity |
|---|---|---|---|---|---|---|
| S-1 | 2 | A | 4.2 | 110 (6.5 mR) | ◎ | ○ |
| S-2* | 2 | B | 4.0 | 110 (6.5 mR) | ○ | ◎ |
| S-3 | 2 | C | 3.8 | 110 (6.5 mR) | ○ | ○ |
| S-4 | 2 | G | 3.2 | 90 (8.0 mR) | X | Δ |
| S-5 | 2 | UMMA-HC** | 3.6 | 200 (3.6 mR) | Δ | X |
| S-6 | UM-Fine** | UMMA-HC** | 3.6 | 100 (7.2 mR) | Δ | Δ |

TABLE 5-continued

| Combination | Screen | Film | Contrast | Combination sensitivity | Detectivity | Marginal detectivity |
|---|---|---|---|---|---|---|
| S-7 | 10 | C | 3.8 | 75 (9.6 mR) | ○ | ○ |
| S-8 | 11 | C | 3.8 | 60 (12 mR) | ○ | ○ |

*Sensitivity and contrast became poor when processed with exhausted developer.
**Commercially available from Fuji Photo Film Co., Ltd.

It is seen from a comparison of combinations S-1, S-2, S-3 and S-4 that the detectivity of mass calcification fibers can be increased at all events by increasing the contrast. A combination with a screen whose fluorescent layer was dyed with carbon black also produced good images, but was undesirable because the sensitivity of the combination was low so that the patient was exposed to a more dose. A favorable use method is by combining a fully high radiance screen with a relatively low sensitivity photosensitive material and adjusting the sensitivity of the combination so as to fall in the range of 4 to 10 mR, whereby a good image involving least deterioration of graininess is obtained with a less exposure. However, in combination S-2 using the photosensitive material film outside the scope of the invention, sensitivity and contrast became poor when processed with the exhausted developer.

Example 4: Evaluation of Combination

Screen 15 to 17 having a surface protective layer with a different gage as shown in Table 6 were prepared by the same procedure as in Example 2 except that a PET film with a different gage was laminated as the surface protective layer. Screens 12 to 14 were similarly prepared by changing the phosphor to a mixture of phosphors having a size of 2 μm and 4 μm.

TABLE 6

| Screen | Reflective layer | Fluorescent layer thickness (μm) | Surface protective layer thickness (μm) | Radiance | CTF (5 lp/mm) |
|---|---|---|---|---|---|
| 12 | carbon black | 110 | 3 | 240 | 0.46 |
| 13 | carbon black | 110 | 6 | 240 | 0.41 |
| 14 | carbon black | 110 | 12 | 240 | 0.33 |
| 15 | carbon black | 80 | 3 | 175 | 0.57 |
| 16 | carbon black | 80 | 6 | 175 | 0.49 |
| 17 | carbon black | 80 | 12 | 175 | 0.38 |

Several systems were obtained by combining these screens with the film. They were evaluated by photographing the RMI phantom as in Example 3. The results are shown in Table 7.

TABLE 7

| Combination | Screen | Film | Contrast | CTF (5 lp/mm) | Combination sensitivity | Detectivity | Marginal detectivity |
|---|---|---|---|---|---|---|---|
| S-9 | 12 | A | 4.2 | 0.46 | 140 (5.2 mR) | ◎ | ○ |
| S-10 | 13 | A | 4.2 | 0.41 | 140 (5.2 mR) | ○ | ○ |
| S-11 | 14 | A | 4.2 | 0.33 | 140 (5.2 mR) | X | X |
| S-12 | 15 | A | 4.2 | 0.57 | 100 (7.2 mR) | ◎ | ◎ |
| S-13 | 16 | A | 4.2 | 0.49 | 100 (7.2 mR) | ◎ | ○ |
| S-14 | 17 | A | 4.2 | 0.38 | 100 (7.2 mR) | Δ | X |
| S-6 | UM-Fine | UMMA-HC | 3.6 | 0.57 | 100 (7.2 mR) | Δ | Δ |

It is evident that the combinations of the invention 30 are achieved by combining the film with a screen having high sensitivity, high X-ray utilization efficiency and good graininess. The screen should have a CTF of at least 0.40 at 5 lp/mm. No substantial improvement in detectivity is found above this level whereas an adverse influence appears below this level.

Example 5: Evaluation of Combination

Screens 18 to 22 (Table 8) were prepared as in Example 2 except that the compression pressure by the calender roll was changed in the range of 0 to 800 kgw/cm$^2$ to thereby change the volume packing factor of phosphor particles in the fluorescent layer. A PET film of 6 μm thick was laminated as the surface protective layer.

TABLE 8

| Screen | Reflective layer | Fluorescent layer thickness (μm) | Fluorescent layer volume packing factor (%) | Protective layer thickness (μm) | Radiance | CTF (5 lp/mm) |
|---|---|---|---|---|---|---|
| 18 | carbon black | 128 | 58 | 6 | 185 | 0.34 |
| 19 | carbon black | 119 | 63 | 6 | 185 | 0.37 |
| 20 | carbon black | 110 | 68 | 6 | 185 | 0.41 |
| 21 | carbon black | 104 | 72 | 6 | 185 | 0.43 |
| 22 | carbon black | 101 | 74 | 6 | 180 | 0.44 |

It is evident that a screen having higher sharpness is obtained by increasing the volume packing factor of phosphor in the fluorescent layer. Better images were obtained when such screens were combined with the photosensitive materials prepared in Example 1, especially when screens 20, 21, and 22 having a packing factor of more than 65% by volume were combined with photosensitive materials having a contrast of at least 3.7.

There has been described a photographic silver halide photosensitive material having high contrast properties suitable for mammography and stability to processing and constituting a novel radiographic system. A photographic combination of this photographic silver halide photosensitive material with a specific intensifying screen constitutes a novel radiographic system featuring an improved balance of image quality and sensitivity.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A photographic silver halide photosensitive material comprising at least two photosensitive emulsion layers only on one side of a support and adapted for use in photographing soft tissue using low-energy X-rays radiated at a tube voltage of less than 40 kVp, wherein said at least two photosensitive emulsion layers are formed of silver halide emulsions having different sensitivities, the sensitivity of the photosensitive emulsion of an uppermost layer is lower than that of a lower layer, said at least two photosensitive emulsion layers are each formed of a silver halide emulsion having an iodide content of less than 0.9 mol % based on the moles of silver, and said silver halide photosensitive material exhibits a contrast of 3.7 to 4.8 as determined by processing the material by Developing Process (1), Developing Process (1) being development at a temperature of 35° C. for a time of 25 seconds with a developer (G) of the following composition:

| | |
|---|---|
| potassium hydroxide | 21 g |
| potassium sulfite | 63 g |
| boric acid | 10 g |
| hydroquinone | 25 g |
| triethylene glycol | 20 g |
| 5-nitroindazole | 0.2 g |
| glacial acetic acid | 10 g |
| 1-phenyl-3-pyrazolidone | 1.2 g |
| 5-methylbenzotriazole | 0.05 g |
| glutaraldehyde | 5 g |
| potassium bromide | 4 g |

the developer (G) being diluted with water to a total volume of 1 liter and adjusted to pH 10.2.

2. The photosensitive material of claim 1 wherein at least one of said at least two photosensitive emulsion layers is formed of a silver halide emulsion having an iodide content of less than 0.3 mol % based on the moles of silver.

3. The photosensitive material of claim 1 wherein at least one of said at least two photosensitive emulsion layers is formed of a silver halide emulsion having a coefficient of variation of silver halide grain size of less than 15%.

4. A photographic combination of the photographic silver halide photosensitive material of claim 1 and a radiographic intensifying screen comprising a phosphor consisting essentially of terbium-activated gadolinium oxysulfide ($Gd_2O_2S$:Tb), said intensifying screen having a contrast transfer function (CTF) of 0.40 to 1.00 at a spatial frequency of 5 lp/mm.

5. The photographic combination of claim 4 wherein the phosphor of the intensifying screen consists essentially of terbium-activated gadolinium oxysulfide ($Gd_2O_2S$:Tb), and a fluorescent layer is substantially undyed and contains the phosphor at a packing factor of 65 to 80% by volume.

6. The photosensitive material of claim 1, wherein the difference in sensitivity as expressed by log E between the low sensitivity emulsion in the uppermost layer and the high sensitivity emulsion in the lower layer is in the range of 0.05 to 0.50.

7. The photosensitive material of claim 1, wherein the difference in sensitivity as expressed by log E between the low sensitivity emulsion in the uppermost layer and the high sensitivity emulsion in the lower layer is in the range of 0.15 to 0.4.

* * * * *